US008456086B2

(12) United States Patent
Eden et al.

(10) Patent No.: US 8,456,086 B2
(45) Date of Patent: Jun. 4, 2013

(54) MICROCAVITY PLASMA DEVICES WITH NON-UNIFORM CROSS-SECTION MICROCAVITIES

(75) Inventors: J. Gary Eden, Champaign, IL (US); Sung-Jin Park, Champaign, IL (US); Kwang Soo, Urbana, IL (US); Andrew J. Price, Savoy, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 75 days.

(21) Appl. No.: 12/682,941

(22) PCT Filed: Oct. 27, 2008

(86) PCT No.: PCT/US2008/081272

§ 371 (c)(1),
(2), (4) Date: Dec. 9, 2010

(87) PCT Pub. No.: WO2009/055765

PCT Pub. Date: Apr. 30, 2009

(65) Prior Publication Data

US 2011/0109224 A1 May 12, 2011

Related U.S. Application Data

(60) Provisional application No. 61/000,389, filed on Oct. 25, 2007.

(51) Int. Cl.
*H01J 17/49* (2006.01)

(52) U.S. Cl.
USPC ..... 313/584; 313/586

(58) Field of Classification Search
USPC ..... 313/582–587; 315/169.4; 345/37, 345/41, 60–62
See application file for complete search history.

(56) References Cited

U.S. PATENT DOCUMENTS 6,194,833 B1 * 2/2001 DeTemple et al. ..... 313/631
7,112,918 B2 9/2006 Eden et al.

(Continued)

FOREIGN PATENT DOCUMENTS

JP 49-29571 3/1974
KR 2003-0045540 6/2003

(Continued)

OTHER PUBLICATIONS

Jessensky. O, et. al,, "Self-organized formation of hexagonal proe arrays in anodic alumina", *Applied Physics Letters*, vol. 72, No. 10, Mar. 9, 1998.

(Continued)

*Primary Examiner* — Nimeshkumar Patel
*Assistant Examiner* — Christopher Raabe
(74) *Attorney, Agent, or Firm* — Greer, Burns & Crain Ltd.

(57) ABSTRACT

An embodiment of the invention IS an array of microcavity plasma devices The array includes a first metal film electrode with a plurality of non-uniform cross-section microcavities therein that are encapsulated in oxide A second electrode is a thin metal foil encapsulated in oxide that is bonded to the first electrode A packaging layer contains gas or vapor in the non-uniform cross-section microcavities To make such device, photoresist is patterned to encapsulate the anodized foil or film except on a top surface at desired positions of microcavities A second anodization or electrochemical etching is conducted to form the non-uniform cross-section sidewall microcavities cavities After removing photoresist and metal oxide, a final anodization lines the walls of the microcavities with metal oxide and fully encapsulates the metal electrodes with metal oxide.

11 Claims, 6 Drawing Sheets

U.S. PATENT DOCUMENTS

| | | | | |
|---|---|---|---|---|
| 7,642,720 | B2 | 1/2010 | Eden et al. | |
| 2006/0012297 | A1 | 1/2006 | Lee et al. | |
| 2006/0071598 | A1 * | 4/2006 | Eden et al. | 313/631 |
| 2006/0082319 | A1 | 4/2006 | Eden et al. | |
| 2006/0284558 | A1 | 12/2006 | Kwon et al. | |
| 2007/0108906 | A1 | 5/2007 | Kang et al. | |
| 2007/0108910 | A1 | 5/2007 | Eden et al. | |
| 2007/0170866 | A1 | 7/2007 | Eden et al. | |
| 2007/0236146 | A1 | 10/2007 | Kang et al. | |

FOREIGN PATENT DOCUMENTS

| | | |
|---|---|---|
| KR | 10-2005-0113533 | 2/2005 |
| WO | WO 2007/011865 | 1/2007 |
| WO | WO 2007/087285 | 8/2007 |
| WO | WO 2008/013820 | 1/2008 |

OTHER PUBLICATIONS

Kim, K.S., et. al., "Self-patterned aluminium interconnects and ring electrodes for arrays of microcavity plasma devices encapsulate in $Al_2O_3$", *J. Phsy. D. Appl. Phys*., 41, 2008, 012004.

Masuda, Hideki, et. al., "Ordered Metal Nanohole Arrays Made by a Two-Step Replication of Honeycomb Structures of Anodic Alumina", *Science*, New Series, vol. 268. No. 5216, Jun. 9, 1995, 1466-1468.

Park, S.J., et. al., "Lighting from thin (,1 mm) sheets of microcavity plasma arrays fabricated in $Al/Al_2O_3$/glass structures: planar, mercury-free lamps with radiating areas beyond 200 $cm^{2}$" *J. Phys. D: Appl. Phys*., 40, 2007, 3907-3913.

Park et. al., "Microdischarge Arrays: A New Family of Photonic Devices", *IEEE Journal on Selected Topics in Quantum Electronics*, vol. 8, No. 1, Jan./Feb. 2002.

Zhou, et. al., "Large-Area Nanowire Arrays of Molybdenum and Molybdenum Oxides: Synthesis and Field Emission Properties", *Avd. Mater*., 2003, 15, No. 21, Nov. 4, 2003.

Datta, M., et. al. "Recent Advances in the Study of Electrochemical Micromachining", *77th Transactions of the ASME: Journal of Engineering for Industry*, 118(1996) February, No. 1.

Kim, Kwang Soo, et. al., "27.3: Fully Addressable, Self-Assembled Microcavty Plasma Arrays: Improved Luminous Efficacy by Controlling Device Geometry", *SID International Symposium*, May 18-23, 2008: May 21, 2008.

Landolt, D., et. al., "Electrochemical micromachining, polishing and surface structuring of metals: fundamental aspects and new developments", *Electrochimica Acta*, 48 (2003) p. 3185-3201.

Park, Sung-Jin, et. al., "Confinement of nonequilibrium plasmas in microcavities with diamond or circular cross sections" Sealed arrays of $Al/Al_2O_3$ /microplasma devices with radiation areas above 20 $cm^2$, *Applied Physics Letters*; 80 (2006), 221501.

Park, Sung-Jin, et. al., "P-90:Large Scale Arrays of Microcavity Plasma Devices Based on Encapsulated $Al/Al_2O_3$ Electrodes: Device Characteristics as a Plasma Display Pixel and Low Cost Wet Chemical Fabrication Processing" *SID International Symposium*, May 20-25, 2007, May 20, 2007.

Park, Sung-Jin, et. al., "Ultraviolet emission intensity, visible luminance, and electrical characteristics of small arryas of $Al/Al_2O_3$microcaviyt plasma devices operationg in $Ar/N_2$ at high-power loadings", *Journal of Applied Physics*, 99 (2006).

* cited by examiner

MICROCAVITY PLASMA DEVICES WITH NON-UNIFORM CROSS-SECTION MICROCAVITIES

PRIORITY CLAIM AND REFERENCE TO RELATED APPLICATION

This application claims priority under 35 U.S.C. §119 from prior provisional application Ser. No. 61/000,389, which was filed on Oct. 25, 2007.

STATEMENT OF GOVERNMENT INTEREST

This invention was made with government support under contract number FA9550-07-1-0003 awarded by Air Force Office of Scientific Research. The government has certain rights in the invention.

FIELD

A field of the invention is microcavity plasma devices (also known as microdischarge devices) and arrays of microcavity plasma devices.

BACKGROUND

Microcavity plasma devices produce a nonequilibrium, low temperature plasma within, and essentially confined to, a cavity having a characteristic dimension d below approximately 500 μm. This new class of plasma devices exhibits several properties that differ substantially from those of conventional, macroscopic plasma sources. Because of their small physical dimensions, microcavity plasmas normally operate at gas (or vapor) pressures considerably higher than those accessible to macroscopic devices. For example, microplasma devices with a cylindrical microcavity having a diameter of 200-300 μm (or less) are capable of operation at rare gas (as well as $N_2$ and other gases tested to date) pressures up to and beyond one atmosphere.

Work done by University of Illinois researchers is disclosed in U.S. Published Application Number 20070170866, to Eden, et al., which is entitled Arrays of Microcavity Plasma Devices with Dielectric Encapsulated Electrodes. That application discloses microcavity plasma devices and arrays with thin foil metal electrodes protected by metal oxide dielectric. The devices and arrays disclosed are based upon thin foils of metal that are available or can be produced in arbitrary lengths, such as on rolls. A method of manufacturing disclosed in the application discloses a first electrode pre-formed with microcavities having the desired cross-sectional geometry. Pre-formed screen-like metal foil, e.g. Al screens used in the battery industry, can be used with the disclosed methods. Oxide is subsequently grown on the foil, including on the inside walls of the microcavities (where plasma is to be produced), by wet electrochemical processing (anodization) of the foil. As disclosed in the application, providing a metal thin foil with microcavities includes either fabricating the cavities in metal foil by any of a variety of processes (laser ablation, chemical etching, etc.) or obtaining a metal thin foil with pre-fabricated microcavities from a supplier. A wide variety of microcavity shapes and cross-sectional geometries can be formed in metal foils according to the method disclosed in the application.

More recent work by University of Illinois researchers discloses buried circumferential electrode microcavity plasma device arrays and a self-patterned wet chemical etching formation method including controlled interconnections between. These results are disclosed in Eden et al., U.S. patent application Ser. No. 11/880,698, filed Jul. 24, 2007, entitled Buried Circumferential Electrode Microcavity Plasma Device Arrays, and Self-Patterned Formation Method, which has been published as WO 08/013,820 on Jan. 31, 2008 and as US 2008-0185579 on Aug. 7, 2008. In a disclosed method of formation in that application, a metal foil or film is obtained or formed with microcavities (such as through holes), and the foil or film is anodized to form metal oxide. One or more self-patterned metal electrodes are automatically formed and buried in the metal oxide created by the anodization process. The electrodes form in a closed circumference (a ring if the cavity shape is circular) around each microcavity, and can be electrically isolated or connected. Prior to processing, microcavities (such as through holes) of the desired shape are produced in a metal electrode (e.g., a foil or film). The electrode is subsequently anodized so as to convert virtually all of the electrode into a dielectric (normally an oxide). The anodization process and microcavity placement determines whether adjacent microcavities in an array are electrically connected or not.

Microcavity plasma devices fabricated in the metal/metal oxide structures described above are inexpensive, flexible and durable. Self-assembly processes can be used to automatically form the buried electrodes via anodization, as described above. However, prior microcavity plasma devices formed by semiconductor fabrication techniques in semiconductors and other materials have offered more control over the cross-sectional geometry (shape) of the microcavities than the anodization processes provided prior to the present invention. A tapered microcavity is provided in Eden, et al. U.S. Pat. No. 7,112,918, Sep. 26, 2006, which is entitled Microdischarge Devices and Arrays Having Tapered Microcavities. The tapered microcavity provides operational advantages, including improved extraction of light produced by plasma generated within the microcavity. However, the angle of the tapered sidewall of microcavities in silicon, for example, is fixed by the crystalline structure of the semiconductor.

SUMMARY OF THE INVENTION

An embodiment of the invention is an array of microcavity plasma devices having microcavities controllable, non-uniform cross-sections. The array includes a first electrode that is a thin metal foil or film having a plurality of non-uniform cross-section sidewall microcavities therein, each of which is encapsulated in oxide. A second electrode is a thin metal foil, encapsulated in oxide, that is bonded to the first electrode, the oxide preventing contact between the first and second electrodes. A packaging layer seals discharge medium (a gas or vapor) into the microcavities.

A method for forming an array of microcavity plasma devices begins with pre-anodizing a metal foil or thin film. Photoresist is patterned onto the anodized metal foil or film to encapsulate the anodized foil or film except on a top surface at the desired positions of microcavities. A second anodization is then conducted to form the microcavities with sidewall profiles that can be controlled precisely.

DETAILED DESCRIPTION OF THE PREFERRED EMBODIMENTS

Figure 1A:
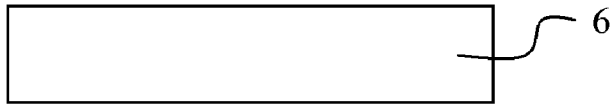
FIG. 1A-1F illustrate a preferred embodiment method for forming an array of microcavity devices with microcavity sidewalls having a controllable profile.

The present invention provides an improved variation of the methods and devices disclosed in U.S. patent application Ser. No. 11/880,698 (incorporated by reference herein) that allows the formation of microcavity plasma devices and arrays having microcavities with controllable sidewall profiles. The non vertical sidewall microcavities in arrays of the invention can have various predetermined shapes, and are formed by a variation of the wet chemical process disclosed in the '698 application. The entire process of forming the microcavities and "wiring them"—producing electrodes and interconnections—can be realized in an inexpensive, wet chemical process. In the present invention, the cross-sectional geometry of the microcavities can be continuously varied from a "bowl" (concave) shape to a pure linear taper. Fabrication methods of the invention can be controlled to produce a predetermined desired shape in the sidewall of the microcavity. This ability to produce a predetermined shape has been previously provided to a limited degree in microcavity plasma devices fabricated by semiconductor fabrication techniques, but not in the inexpensive arrays of microcavity plasma device arrays fabricated in metal/metal oxide structures. See, Eden, et al. U.S. Pat. No. 7,112,918, Sep. 26, 2006, which is entitled Microdischarge Devices and Arrays Having Tapered Microcavities.

The present invention extends the advantages offered by the tapered microcavities in the '918 patent to the metal/metal oxide device arrays that are formed by inexpensive wet chemical formation processes. Microcavity plasma device arrays of the invention provide advantages for tailoring and optimizing emission and the operating characteristics of the array of microcavities. The ability to produce microcavities having a predetermined sidewall shape allows for tailoring and optimizing the efficiency and operating parameters (excitation voltage, frequency, gas pressure, etc.) of an array of microplasma devices. Another benefit of controlling the cross-sectional profile of the microcavity is the ability to optimize extraction of photons (produced by the microplasma) from the microcavity.

In addition, tapered sidewall microcavities provide a large positive differential resistance that decreases power consumption while improving the linearity of the V-I characteristics. This characteristic permits self-ballasting of the devices and simplifies external control circuitry. The thin sheet metal/metal oxide arrays reported prior to the invention offer many advantages, including ease of fabrication, transparency, and flexibility. These advantages are retained by arrays of the invention, which also provide the advantages offered by non-uniform cross-section microcavities. Microdischarge devices with tapered cavities also exhibit an increase in surface area relative to a conventional planar structure, thereby enabling modification of the electrical properties of devices. In addition, increased output (radiant) efficiencies are obtained by coating the tapered side walls with an optically reflective conductive coating or a coating with a relatively small work function. Arrays of non-uniform cross-section microcavity plasma devices produce higher output power and exhibit ignition characteristics superior to those of otherwise similar arrays with uniform cross section microcavities having vertical sidewalls. The primary reason for this improved performance is the ability to shape the cavity sidewalls so as to optimize the electrical field profile within the microcavity.

An example embodiment array of microcavity devices of the invention includes a first electrode, the first electrode being a thin metal foil having a plurality of non-uniform cross-section microcavities therein that are encapsulated in oxide. A second electrode is a thin metal foil encapsulated in oxide that is bonded to the first electrode, and the oxide prevents contact between the first and second electrodes. A packaging layer seals the discharge medium (a gas or vapor or mixture thereof) into the microcavities. Exemplary microcavities include microcavities having bowl style sidewalls or sidewalls with linear tapers. The microcavities in preferred embodiment arrays of microcavity devices have a predetermined desired sidewall shape.

A preferred embodiment fabrication process of the invention includes pre-anodization of a metal foil or thin film. The parameters of the pre-anodization determine the thickness of the metal oxide formed in pre-anodization which is the primary factor determining the shape of the resulting microcavity. After pre-anodization, photoresist (PR) is patterned onto the anodized metal foil or film to encapsulate the partially anodized foil or film except on the top surface at the desired positions of microcavities. Encapsulating the foil or film with photoresist, including the back side (and edges), ensures that a second anodization of the foil will not occur uniformly with respect to the front and rear surfaces of the foil. A second anodization is then conducted to form microcavities having a desired sidewall shape. The microcavities form with non uniform cross-section because anodization from the rear surface of the foil has been blocked by the PR coating. The exact shape of the cavity produced is a function of the foil thickness, initial anodization time (and, hence, oxide thickness), and the second anodization time.

Devices of the invention are amenable to mass production techniques which may include, for example, roll to roll processing to bond together the first and second thin layers with buried electrodes. Embodiments of the invention provide for large arrays of microcavity plasma devices that can be made inexpensively because they are literally fabricated from aluminum foil by wet chemical processing. Also, exemplary devices of the invention are formed from thin layers that are flexible and are at least partially transparent in the visible region of the spectrum.

The structure of preferred embodiment microcavity plasma devices of the invention is based upon foils (or films) of metal that are available or can be produced in arbitrary lengths, such as on rolls. In a method of the invention, a pattern of microcavities is produced in a metal foil that is subsequently anodized, thereby resulting in microcavities in a metal-oxide (rather than the metal) with each microcavity surrounded (in a plane transverse to the microcavity axis) by a buried metal electrode. During device operation, the metal oxide protects the microcavity and electrically isolates the electrode from the plasma within the microcavity.

A second metal foil is also encapsulated with oxide and can be bonded to the first encapsulated foil. The second metal foil forms a second electrode(s). For one preferred embodiment microcavity plasma device array of the invention, no particular alignment is necessary during bonding of the two encapsulated foils. In another embodiment of the invention, the second electrode comprises an array of thin parallel metal lines buried in the metal-oxide. The entire array, comprising two metal-oxide sheets with buried electrodes, can be sealed with thin glass, quartz, or even plastic windows, for example, with the desired gas or gas mixture sealed within.

Preferred materials for the metal electrodes and metal oxide are aluminum and aluminum oxide ($Al/Al_2O_3$). Another exemplary metal/metal oxide material system is titanium and titanium dioxide ($Ti/TiO_2$). Other metal/metal oxide materials systems will be apparent to artisans. Preferred material systems permit the formation of microcavity plasma device arrays of the invention by inexpensive, mass production techniques such as roll to roll processing.

Preferred embodiments will now be discussed with respect to the drawings. The drawings include schematic figures that are not to scale, which will be fully understood by skilled artisans with reference to the accompanying description. Features may be exaggerated for purposes of illustration. From the preferred embodiments, artisans will recognize additional features and broader aspects of the invention. The preferred embodiment devices and methods of fabrication discussed concern $Al/Al_2O_3$ arrays of microcavity plasma devices, but other metal and metal oxides can also be used, such as titanium and titanium dioxide.

FIGS. 1A-1F illustrate a preferred embodiment method for forming an array of microcavity devices with non-uniform cross-sectional geometries of the invention. The method is capable of producing microcavities having a desired sidewall shape, which can range from a bowl-style shape to a linear taper. The present process has been used in experiments to form example devices, and artisans will appreciate broader aspects of the invention from the example experiments. The basic method of FIGS. 1A-1F will be discussed along with experimental details. The particular dimensions, conditions and durations of the experiments do not limit the invention, but provide a specific example embodiment method that will produce an array of microcavity plasma devices in which the microcavities have a predetermined (desired) sidewall shape.

Figure 1B:
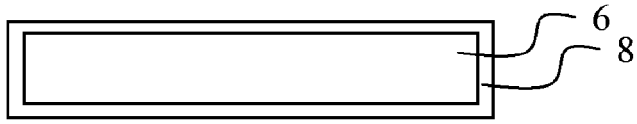
Figure 1C:
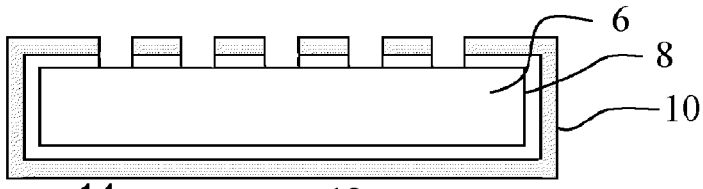

In FIG. 1A, a metal foil 6 is provided and the foil 6 is pre-anodized in FIG. 1B to form a coating of metal oxide 8. It is important to note that although the metal oxide is referred to as "a coating" on the foil, in reality a portion of the foil has been converted chemically into an oxide. A typical experimental process used an Al foil of about 30 μm thickness, although foils with thicknesses above 120 μm have also been processed successfully. The pre-anodization of FIG. 1B is important in determining the shape of the resultant microcavities that are formed later. With metal foils of about 30 μm, experiments successfully used a pre-anodization time of as little as about 1 min. and up to about 1 hour. Typically, the pre-anodization process occurred in 0.3 M oxalic acid at a temperature of 15° C. and a voltage of 40 V. The thickness of the metal oxide ($Al_2O_3$ in the experiments) formed by pre-anodization is a primary factor determining the shape of the resulting microcavities. In FIG. 1C, photoresist 10 is patterned onto the metal oxide 8 by completely encapsulating the metal/metal oxide sheet except on the top surface at the desired positions of microcavities to be formed. Coating the back side (and edges) of the foil 6 with photoresist ensures that a second anodization of the foil will not occur uniformly with respect to the front and rear surfaces of the foil.

Figure 1D:
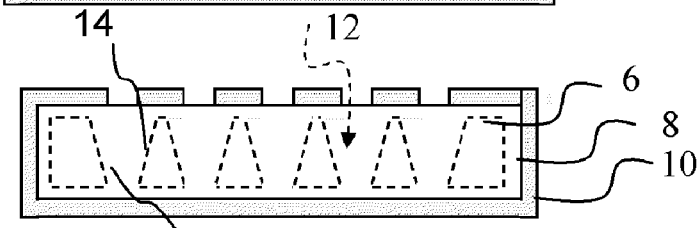
Figure 1E:
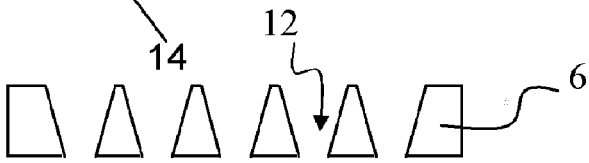

After the photoresist is patterned and openings are produced in the underlying metal oxide by etching, the anodization process is continued in FIG. 1D until the foil 6, 8 is breached beneath each of the openings in the photoresist and microcavities 12 are formed in the foil 6, 8. The microcavities 12 are formed in the foil 6, 8 with a non-uniform cross-section as indicated by sidewalls 14 in FIG. 1D. FIG. 1E shows a cross-section of the foil that remains after the photoresist and metal oxide of FIG. 1D have been removed by etching. Much of the original metal is gone, having been converted into metal oxide. The microcavity sidewalls 14 are not vertical because anodization from the rear surface of the foil 6, 8 was blocked during the process of FIG. 1D by the photoresist coating. Hence, a non-symmetrical anodization occurs. The photoresist and metal oxide of FIG. 1D are readily removed by etching in appropriate acids, respectively, leaving behind the metal layer 6 having microcavities 12 with the desired shape. Although the drawing of FIG. 1E (and 1F) implies that the cavity sidewalls are linear, that need not be the case. The precise profile of the microcavity sidewall is determined by the thickness of the metal-oxide layer 6, 8 in FIGS. 1B and 1C, and the anodization time in FIG. 1D. FIG. 2 illustrates qualitatively the continuous variation in microcavity sidewall profiles that is obtainable by the processing sequence of FIGS. 1A-1E. Extensive testing of the FIGS. 1A-1E process and inspection of the resulting cavities with optical and electron microscopes has shown that arrays exhibit uniform emission and the V-I characteristics have a positive slope that eliminates the need for external ballasting In addition to the breadth of cavity shapes that is achievable with this invention, the cavity sidewall morphology is extremely smooth. Measurements show that the RMS roughness of the microcavities of FIG. 1E (formed by process sequence 1A-1D) is well under 1 μm. If the thin metal sheet of FIG. 1E is anodized one final time, one obtains the microcavity array shown in cross section in FIG. 1F. The microcavities have a cross-sectional profile determined by the process steps of FIGS. 1A-1E but in FIG. 1F the metal electrode(s) 6 are now buried in metal oxide 8. In fact, the electrode(s) 6 are all that remain of the original metal foil 6 of FIG. 1A. It must be emphasized that the microcavity geometry and sidewall profile of FIG. 1E have been preserved in FIG. 1F. The change from FIG. 1E to 1F is that the wet chemical anodization process has converted most of the metal into metal oxide 8 so that metal oxide now lines the wall of the microcavity.

Figure 1F:
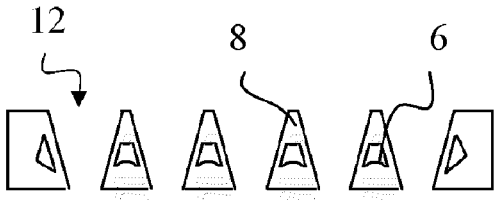
Figure 2:
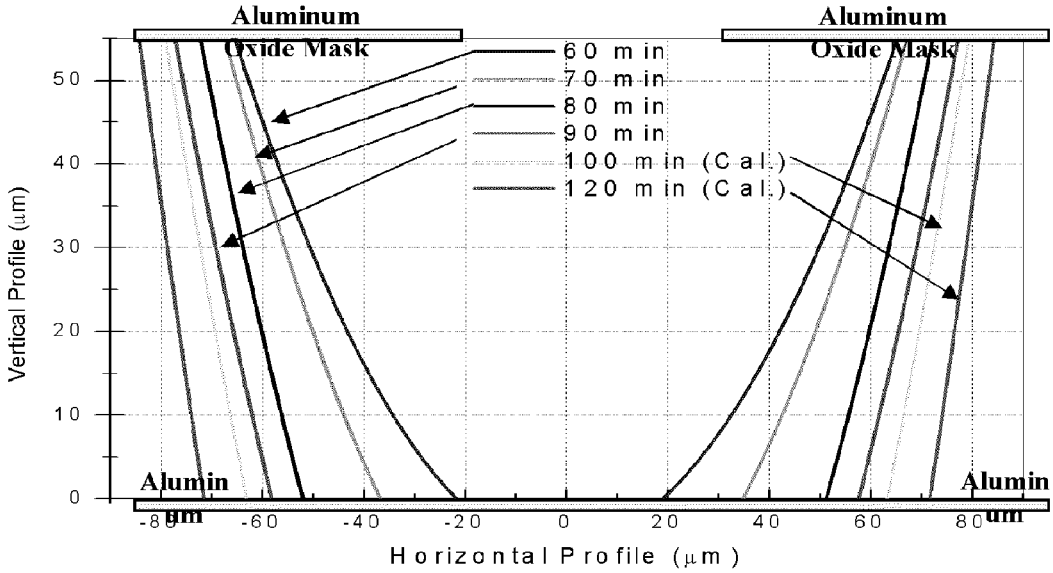
FIG. 2 illustrates a continuous range for microcavity cross-sectional profiles that are available with methods of the invention.

The electrode(s) 6 associated with the microcavities 12 of FIG. 1F can be interconnected in patterns that are controllable. The degree of anodization and the microcavity spacing determine the patterning of electrode interconnections between microcavities that occurs automatically during the course of anodization. The anodization process and microcavity placement determine whether adjacent microcavities in an array are electrically connected or not.

As seen in FIG. 1F, the thickness of the electrode 6 is the largest in proximity to a microcavity but decreases away from the microcavity. Although not seen in the cross-section of FIG. 1F, each electrode 6 surrounds each respective microcavity and is azimuthally symmetric (if the cavities 12 have a circular cross-section). Also, the layer of metal-oxide dielectric 8 exists between the inner edge of electrode 6 and the wall of the microcavities 12.

The exact shape of the microcavities 12 produced in the foil 6 by the processes of FIGS. 1A-1F is a function of the foil thickness, initial anodization time (and, hence, oxide thickness), and second anodization time. In an experimental example, microcavities were formed with a slightly curved taper. In other experiments, bowl-shaped (parabolic) microcavities were formed. As one example, microcavities formed in $Al/Al_2O_3$ had an upper aperture with a diameter of 135±5 μm whereas the diameter of the aperture at the base of the microcavities was 76±4 μm. The uncertainty in each measurement represents one standard deviation.

Optical micrographs were recorded of 50×160 arrays of microcavities devices fabricated with 2 min. of initial anodization. In fabricating these devices, 50×50 $\mu m^2$ square apertures were opened in the photoresist as shown in FIG. 1C. After anodization, however, the microcavities formed are circular when viewed from above. Consequently, once the foil is finally anodized, two circles associated with each microcavity could be seen in plan view SEM images. The larger diameter of the two was the upper aperture of the microcavity and the smaller diameter is the lower aperture or back side of the cavity. Other images taken of completed microcavities with buried and self-patterned electrodes showed that the electrodes do, indeed, surround each microcavity and are disposed in a plane that is generally perpendicular to the axis of the microcavities.

Figure 3A:
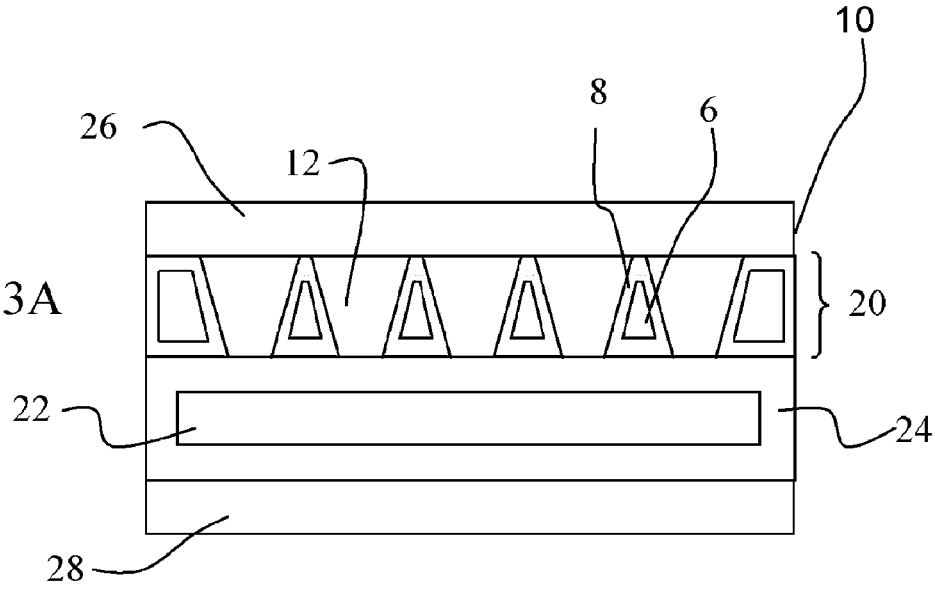
FIG. 3A is a schematic diagram of another array of microcavity plasma devices of the invention.

FIG. 3A is schematic diagram of a lamp formed from an array 20 of microcavity devices in a thin metal and metal oxide sheet. The array 20 includes microcavities 12 having sidewalls with the desired profile and isolated from thin metal electrodes 6 by oxide 8. A second, common electrode 22 is formed in a second thin sheet that includes the electrode 22 and an encapsulating layer of metal oxide 24. The common electrode 22 and metal oxide sheet is preferably formed from a thin metal foil that has been anodized to encapsulate the metal foil 22 in the metal oxide 24. The lamp is packaged in thin packaging layers 26, 28 to seal vapor, gas or mixtures of gases and/or vapors in the microcavities. Application of a time-varying voltage of the proper magnitude between the electrodes 6 and 22 ignites and sustains plasma within the microcavities.

The packaging layers can be selected from a wide range of suitable materials, which can be completely transparent to emission wavelengths produced by the microplasmas or can, for example, filter the output wavelengths of the microcavity plasma device array 10 so as to transmit radiation only in specific spectral regions. Example materials include thin glass, quartz, or plastic layers. The discharge medium can be at or near atmospheric pressure, permitting the use of a very thin glass or plastic layer because of the small pressure differential across the packaging layers 26 and 28, which can also be a single layer that surrounds the entire array. Polymeric vacuum packaging, such as that used in the food industry to seal various food items, can also be used as a packaging layer.

It is within each microcavity 12 that a plasma (discharge) will be produced. The first and second electrodes 6, 22 are spaced apart a distance from each other by the respective thicknesses of their oxide layers. The oxide thereby isolates the first and second electrodes from one another and, additionally, isolates each electrode from the discharge medium (plasma) contained in the microcavities 12. This arrangement permits the application of a time-varying (AC, RF, bipolar or pulsed DC, etc.) potential between the electrodes to excite the gaseous or vapor medium to create a microplasma in each microcavity 12.

Figure 3B:
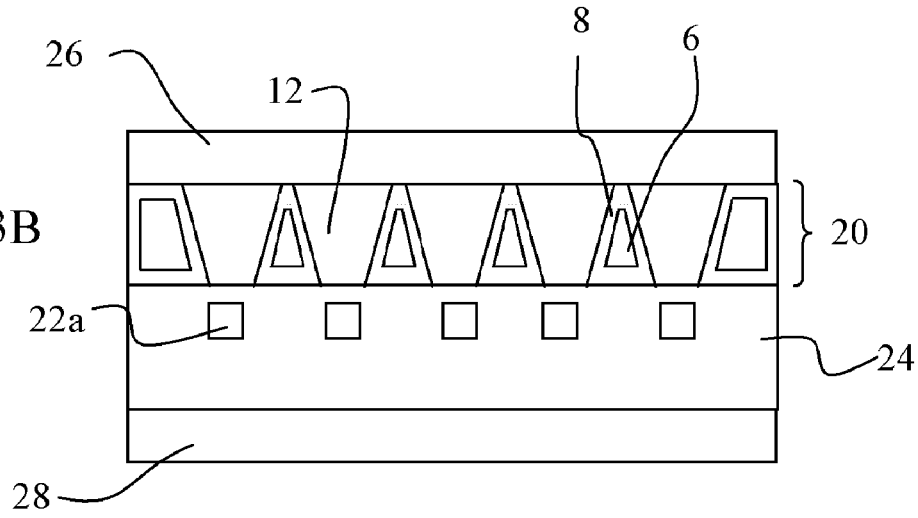
FIG. 3B is a schematic diagram of an addressable array of microcavity plasma devices of the invention.

The benefit of patterning the electrode 22*a* is that the capacitance of the array is reduced dramatically. Furthermore, the structure of FIG. 3B allows for addressing of individual microcavities. FIG. 3B shows another array of microcavity plasma devices that includes a second electrode 22*a* that provides for addressing of individual microcavities 12 in the array 20. The second electrode 22*a* can be formed by photolithography followed by uniform (from both sides of a metal foil) anodization, or can be formed by anodizing a patterned foil that has holes formed by conventional methods.

Figure 4:
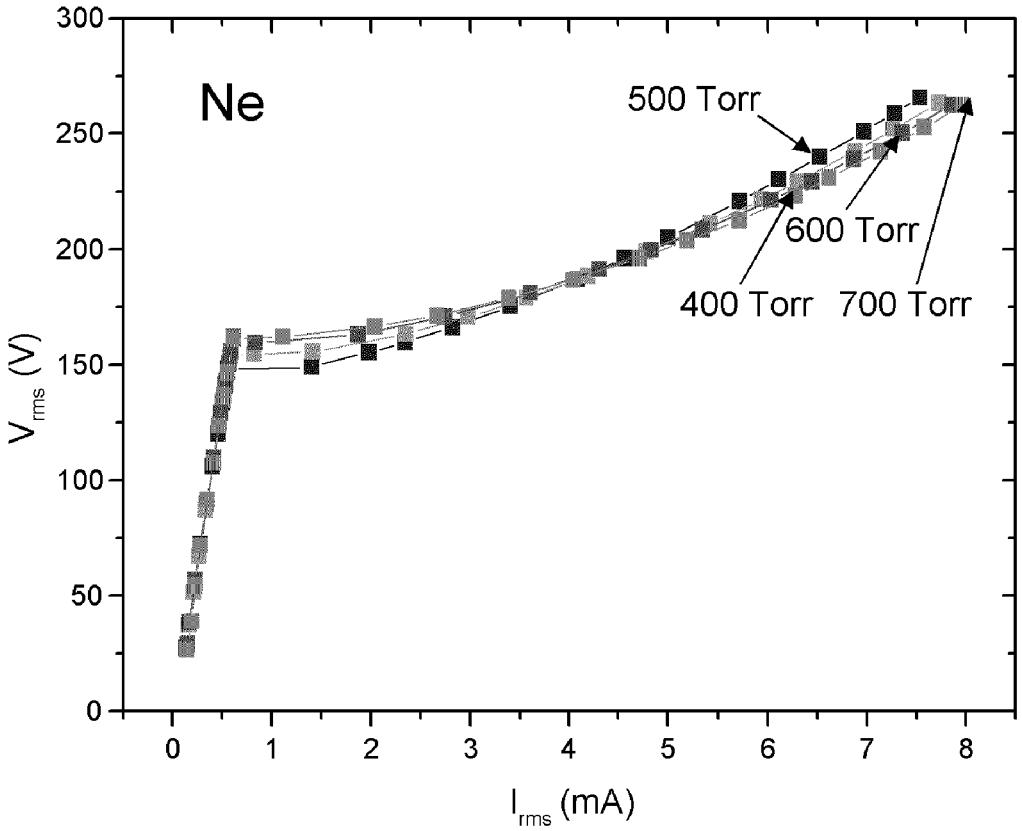
FIG. 4 presents voltage-current (V-I) characteristics of an array of microcavity plasma devices of the invention operating in 400, 500, 600 and 700 Torr of Ne.
Figure 5:
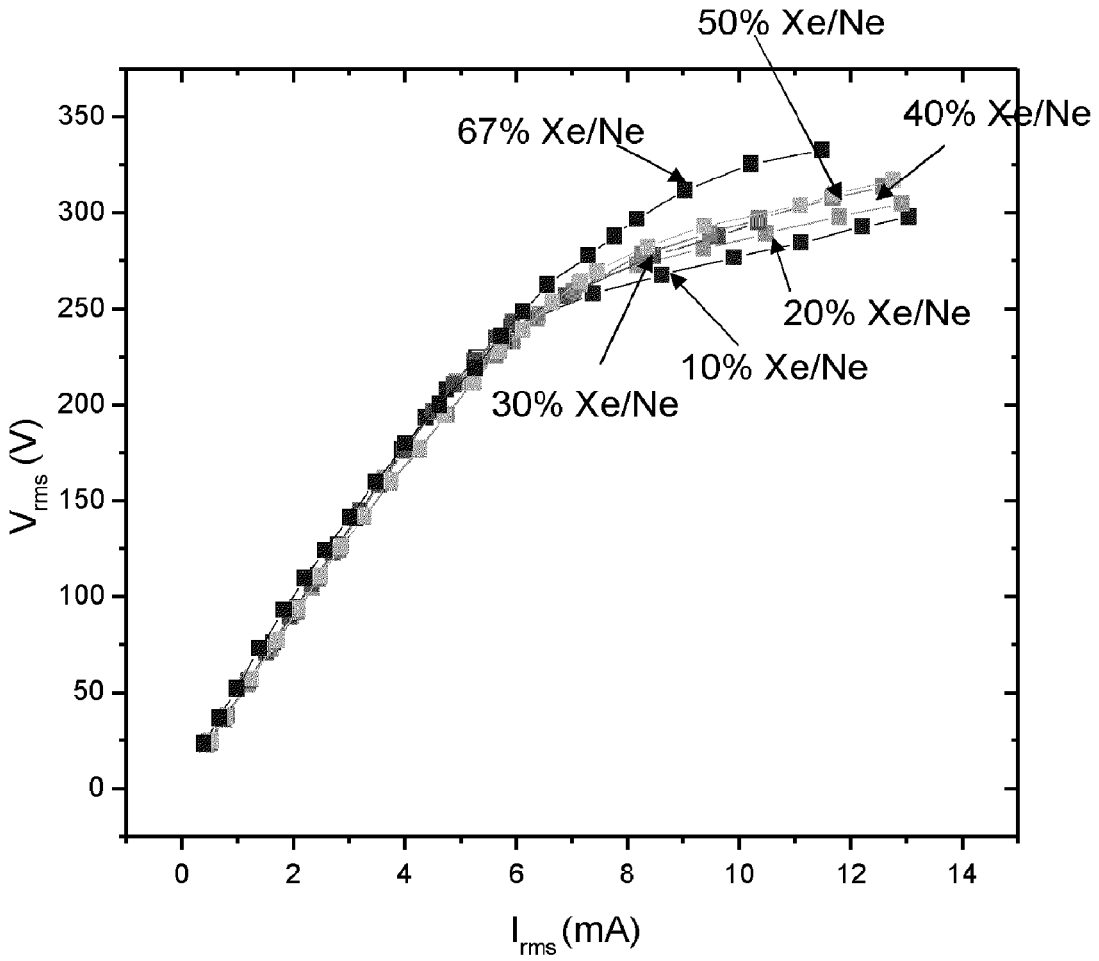
FIG. 5 presents V-I characteristics of an array of microcavity plasma devices of the invention operating in Ne/Xe mixtures at a total pressure of 400 Torr and Xe concentrations of 10, 20, 30, 40, and 50%.

FIG. 4 presents V-I characteristics of an array of microcavity plasma devices of the invention operating in 400, 500, 600 and 700 Torr of Ne. The performance of the array at the four pressures is highly similar. Slight bending of the array was apparent, but that can be eliminated by the use of stress reduction techniques disclosed in Eden et al., U.S. patent application Ser. No. 12/152,550, and PCT Application PCT/US08/06226, both filed May 15, 2008, and entitled Arrays of Microcavity Plasma Devices with Reduced Mechanical Stress. In that application, various stress reduction strategies are disclosed. Stress reduction can be realized by various geometries and structures, including voids between rows of microcavities and support ribs formed of photoresist between microcavities on one or both sides of the array of microcavities. Conducting a symmetrical final anodization can also provide stress reduction. With the stress reduction strategies, even large arrays of microcavity plasma devices can be kept almost perfectly flat, which provides improved emission uniformity over an array. With proper care given to keeping the array flat, the emission from device-to-device is quite uniform. FIG. 5 presents V-I characteristics of an array of microcavity plasma devices of the invention operation in Ne/Xe mixtures with Xe concentrations of 10%, 20%, 30%, 40%, 50%, and 67%. The V-I characteristics of FIG. 4 and in FIG. 5 show that these arrays are well-behaved. That is, the V-I characteristics have a positive slope that eliminates the need for external ballasting.

Figure 6A:
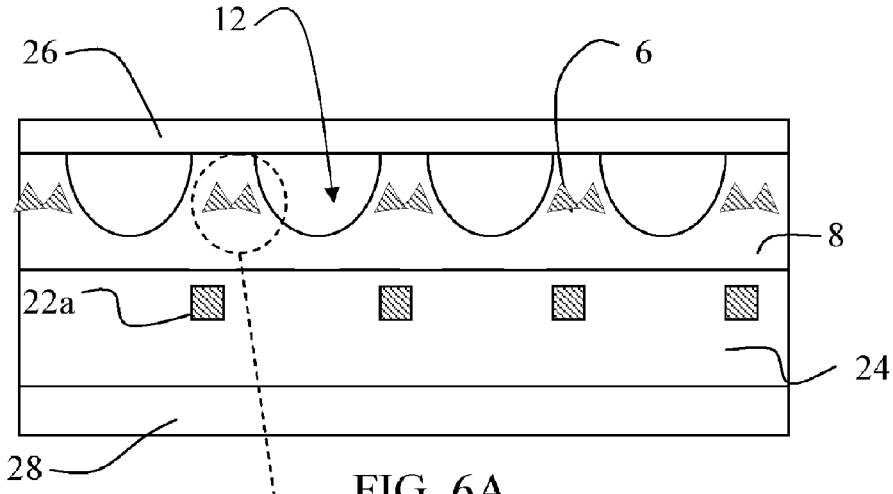
FIGS. 6A and 6B show a schematic cross-section of another array of microcavity plasma devices of the invention, illustrating the formation of microcavities with curved sidewalls.
Figure 6B:
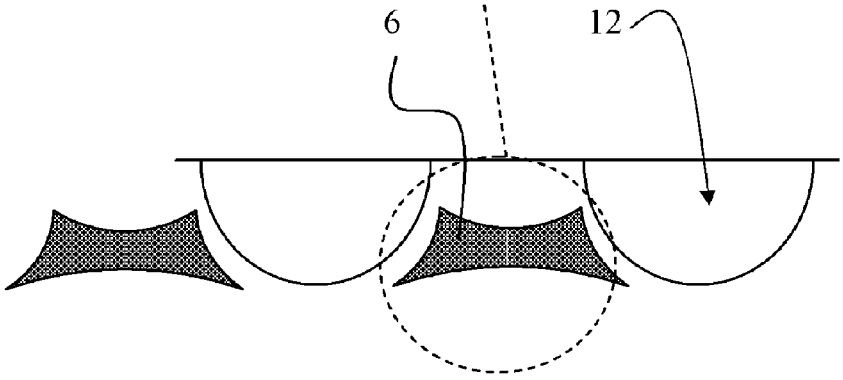

FIGS. 6A and 6B show another preferred embodiment array of microcavity plasma devices that is similar to the array in FIG. 3B, but includes bowl-shaped microcavities 12. The array of FIGS. 6A and 6B is labeled with reference numbers used in FIG. 3A. In addition, the electrodes 6 are illustrated as being interconnected, which can be accomplished by controlling the microcavity spacing and anodization, as discussed above. Thus, the four bowl-shaped (parabolic wall profile) microcavities of FIGS. 6A and 6B are electrically interconnected, as best seen in the partial blow-up view in FIG. 6B. Also, the electrodes 6 near the microcavity walls have the same shape as the microcavity walls and the interconnects will become thinner further away from the microcavities 12.

Arrays of the invention have many applications. Addressable devices can be used as the basis for both large and small high definition displays, with one or more microcavity plasma devices forming individual pixels or sub-pixels in the display. Microcavity plasma devices in preferred embodiment arrays, as discussed above, can produce a plasma to photoexcite a phosphor so as to achieve full color displays over large areas. An application for a non-addressable or addressable array is, for example, as the light source (backlight unit) for a liquid crystal display panel. Embodiments of the invention provide a lightweight, thin and distributed source of light that is preferable to the current practice of using a fluorescent lamp as the backlight. Distributing the light from a localized lamp in a uniform manner over the entire liquid crystal display requires sophisticated optics. Non-addressable arrays provide a lightweight source of light that can also serve as a flat lamp for general lighting purposes. Arrays of the invention also have application, for example, in sensing and detection equipment, such as chromatography devices, and for phototherapeutic treatments (including photodynamic therapy). The latter include the treatment of psoriasis (which requires ultraviolet light at ~308 nm), actinic keratosis and Bowen's disease or basal cell carcinoma. Inexpensive arrays sealed in glass or plastic now provide the opportunity for patients to be treated in a nonclinical setting (i.e., at home) and for disposal of the array following the completion of treatment. These arrays are also well-suited for photocuring of polymers which requires ultraviolet radiation, or as large area, thin light panels for applications in which low-level lighting is desired.

While specific embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

The invention claimed is:

1. An array of microcavity devices, comprising:

a first electrode, the first electrode being a thin metal foil or film including a plurality of non-uniform cross-section microcavities therein and being encapsulated in oxide of the metal of the thin metal foil;

a second electrode being a thin metal foil encapsulated in oxide that is bonded to the first electrode, the oxide preventing contact between the first and second electrodes;

at least one packaging layer that contains discharge medium in the microcavities.

2. An array of claim 1, wherein the microcavities have bowl shaped sidewalls.

3. The array of claim 1, wherein the microcavities have tapered sidewalls.

4. The array of claim 3, wherein the tapered sidewalls have a linear taper.

5. The array of claim 1, wherein said first electrode comprises a plurality of interconnected electrodes.

6. The array of claim 5, wherein said second electrode comprises a plurality of second electrodes arranged to permit addressing of said non-uniform cross-section microcavities.

7. The array of claim 1, wherein the thin metal foils of the first and second electrodes comprise aluminum and the oxide of said first and second electrodes comprises aluminum oxide.

8. The array of claim 1, wherein the thin metal foils of the first and second electrodes comprise titanium and the oxide of said first and second electrodes comprises titanium dioxide.

9. The array of claim 1, wherein the packaging layer is one of a glass or polymer.

10. A method for forming an array of microcavity devices, comprising:

pre-anodizing a metal foil or thin film;

patterning photoresist onto the anodized metal foil or film to encapsulate the anodized foil or film except on a top surface at desired positions of microcavities;

conducting a second anodization or electrochemical etching to form the non-uniform cross-section microcavities;

removing the photoresist and metal oxide;

conducting a final anodization so as to line the cavities with metal oxide and completely bury the metal electrodes in metal oxide.

11. The array of claim 1, wherein the first electrode consists of the thin metal foil or film including a plurality of non-uniform cross-section microcavities therein and being encapsulated in oxide of the metal of the thin metal foil.

* * * * *

UNITED STATES PATENT AND TRADEMARK OFFICE

CERTIFICATE OF CORRECTION

PATENT NO. : 8,456,086 B2
APPLICATION NO. : 12/682941
DATED : June 4, 2013
INVENTOR(S) : J. Gary Eden et al.

It is certified that error appears in the above-identified patent and that said Letters Patent is hereby corrected as shown below:

On the Title Page:

Item (56), under "Other Publications":

| | |
|---|---|
| Page 2, Col. 2, line 11 | Please delete "Microcaty" and insert --Microcavity-- therefor. |
| Page 2, Col. 2, line 27 | After "small" please delete "arryas" and insert --arrays-- therefor. |
| Page 2, Col. 2, line 28 | After "$Al/Al_2O_3$" please delete "microcaviyt" and insert --microcavity-- therefor. |
| Page 2, Col. 2, line 28 | After "plasma devices" please delete "operationg" and insert --operating-- therefor. |

Signed and Sealed this
Twenty-fifth Day of February, 2014

Michelle K. Lee

Michelle K. Lee
*Deputy Director of the United States Patent and Trademark Office*